US006282845B1

(12) United States Patent
Hines

(10) Patent No.: US 6,282,845 B1
(45) Date of Patent: Sep. 4, 2001

(54) GUTTER ANTI-CLOGGING LINER

(76) Inventor: M. Gene Hines, 1401 Iroquois, Chouteau, OK (US) 74337

( * ) Notice: Subject to any disclaimer, the term of this patent is extended or adjusted under 35 U.S.C. 154(b) by 0 days.

(21) Appl. No.: 09/643,265

(22) Filed: Aug. 22, 2000

(51) Int. Cl.[7] ..... E04D 13/064
(52) U.S. Cl. ..... 52/12
(58) Field of Search ..... 52/12, 11; 210/162, 210/163, 164, 469

(56) References Cited

U.S. PATENT DOCUMENTS

| | | | | |
|---|---|---|---|---|
| 4,406,093 | | 9/1983 | Good | 52/11 |
| 4,418,504 | * | 12/1983 | Lassiter | 52/12 |
| 4,607,465 | * | 8/1986 | Hopkins | 52/12 |
| 4,745,709 | | 5/1988 | Johnson | 52/2 |
| 4,905,427 | | 3/1990 | McPhalen | 52/12 |
| 4,949,514 | | 8/1990 | Weller | 52/12 |
| 4,964,247 | | 10/1990 | Spica | 52/12 |
| 5,103,601 | | 4/1992 | Hunt | 52/12 |
| 5,522,183 | * | 6/1996 | Allen | 52/12 |

* cited by examiner

*Primary Examiner*—Michael Safavi
(74) *Attorney, Agent, or Firm*—Molly D. McKay

(57) ABSTRACT

A liner for a rain gutter and the like comprises a sheet of rigid material which fits independently down inside a gutter underneath any cross-pieces to form an upper longitudinally extending barrier surface and a lower longitudinally extending liquid passageway. The horizontal plane of the liner is bent to form an angle with a short plane which rests against the bottom and front wall of the gutter and a long plane which rests against the upper portion of the rear wall of the utter. In this position, the liner sets above the bottom of the gutter at an angle that slopes down and away from the roof structure. The barrier surface of the liner has a plurality of openings sufficient in size to allow liquids to pass through to the lower passageway, but sufficiently small in size to restrict any solid debris from entering into the lower passageway. No tools or fasteners are required for installation and no attachments are made to either the gutter itself or roof structure.

1 Claim, 2 Drawing Sheets

GUTTER ANTI-CLOGGING LINER

CROSS-REFERENCE TO RELATED APPLICATION

Not Applicable

BACKGROUND—Field of the Invention

This invention relates to a liner which is placed inside a rain gutter for the expressed purpose of restricting leaves, twigs, pine needles, or other debris from entering the lower passageway of a gutter (while allowing the flow of rain water to proceed into the lower passageway of the gutter and move unrestricted down the downspout).

BACKGROUND—Discussion of Prior Art

In the prior art there are three general types of devices which relate to controlling water run off and restricting the entry of leaves and other debris from entering the gutter. They are:

1. Lattice-type screen or sieve devices which are placed over the open mouth of the gutter, allowing the water to flow through to the gutter tray. Some of these devices are inserted under the roof shingle and attached to the outside top flange of the gutter. Others use various screws, clips, hooks, springs, glue or caulking in order to fasten the device to the gutter/roof. In all cases these devices are attached (in some fashion) to the gutter, shingles, roof sheathing, or fascia board.

Problems with these type devices are:

a. In many cases leaves and debris, which get caught in the latticework, lay on top of the device and sometimes completely cover the screen or sieve openings. The result is that the flow of water especially during heavy, rain storms is restricted from entering the gutter and flows out over the obstructing debris onto the ground below. Water run-off over top of these devices is especially prevalent when the roof pitch is steep. In extreme situations, the entire gutter guard is blocked by debris, effectively preventing any water from reaching the gutter. In these cases the water can seep back up under the shingles and cause damage to the roof sheathing or fascia board.

b. Some of these devices are made of flexible or very light weight material which does not hold tip under pressure from excessive debris, ice, or snow. Instead they collapse, bend, break, or come loose from their attachments. Unless securely fastened they can become dislodged by wind or heavy rain and fall into the gutter tray or over the side to the ground.

c. Ice and snow can be a big problem for these type devices. They are ineffective in eliminating damage to roof shingles, sheathing, or fascia board from melting snow and ice dams. In that they are installed on top of the gutter assembly and generally cover the gutter mouth, snow and ice accumulation on top of the guard close to or on top of the drip edge portion of the roof is inevitable. Water from the melting ice and/or snore will back-up under the over-lapping roof shingles and eventually to the roof sheathing and fascia board causing damage to same.

d. Installation of these devices can and in many cases does disrupt the integrity of the roof and gutter system causing damage to same. Placing the device under roof shingles or using screws, clips, hooks, springs, glue, or caulk all require time to install and can create difficulties in the future when the units becoming loosened or dislodged as a result of excessive debris buildup. In some cases, they are inadequately fastened to the gutter and thus are frequently dislodged during unfavorable weather conditions.

e. Installation time and expense can be quite high depending on the complexity of design and necessity for securely fastening the device to the roof and gutter system.

f. Those who install these devices claim they are maintenance-free; but in actuality they do require maintenance. Such situations as referenced above in a, b, c, and d all contribute to a need for maintaining the system.

2. Perforated or solid cover/deflector devices which completely enclose the mouth of the gutter to prevent the accumulation of snow, leaves, and debris within the gutter while allowing the water to flow through various style openings. Many of these devices work on scientific principles or concepts like surface tension, liquid adhesion, or molecular attraction. Problems with these type devices are:

a. Similarly, although not as severe as the lattice-type devices, leaves and debris do get caught on or adhere to the top of the guard. The accumulation of this material will, like the above devices, affect the flow of water down into the openings.

b. These devices work well during normal weather conditions where the rain gently falls and no debris has accumulated, but during heavy rain storms or high winds the scientific principles that these systems work on can negatively affect the system and allow the water to wash out over the device onto the ground. Also the accelerated flow of water down a steep pitched roof does not allow these devices opportunity to perform their designed function of drawing the water into the openings. Instead much of the water flows out over the cover and onto the ground. Water quantity and velocity have a tendency to negatively impact the water carrying capacity of all of these systems.

c. Since these devices are generally securely attached to the very top of the gutter assembly, ice and snow can also be a problem. Like the lattice-type, snow and ice accumulation on top of the guard (close to or on top of the drip edge portion of the roof) is inevitable. Water from the melting will back-up under the overlapping roof shingles and eventually to the roof sheathing causing damage to same.

d. These perforated or solid cover/deflector devices are generally bulky and difficult to install. Many require already installed gutter systems to be replaced, repositioned, or modified in order to correctly, install. They are very expensive to manufacture and install which limits their potential as an inexpensive solution to gutter/water flow problems.

e. Installation of these devices like the lattice-type can and in many cases disrupt the integrity of the roof and gutter system causing damage to same. Attaching the covers by using screws, clips, hooks, springs, glue, or caulk can create difficulties in the future when the units becoming loosened or dislodged as a result of excessive unfavorable weather conditions or debris buildup.

f. The claim is also made that these devices are maintenance-free. Although they require less maintenance than the lattice-type, they do require some maintenance. Such situations as referenced above in a, b, c, and d all contribute to a need for maintaining the system.

3. Liners or inserts which fit down inside a gutter and act as a barrier to leaves and debris while allowing water to flow through various apertures. Problems with these type devices are:

a. Some of these devices are designed primarily to provide a mechanical means for cleaning out debris and are expensive to manufacture and install. Because of the mechanical nature and a need for flexibility in these devices, they often require frequent maintenance or are not strongly enough to hold up under excessive debris or extreme weather conditions.

b. Those devices which are not designed for easy clean out are generally either not strong enough to hold up under the weight of excessive debris, ice and snow or become easily blocked by the same; thus defeating the very purpose for which they were installed.

To summarize, cutters are installed to protect a house from water damage. Anytime a guard (whether a screen, cover, or liner) is placed over the mouth of the gutter to solve a leaf/debris problem, water damage protection is diminished. Clogged gutters from leaves and debris is reduced; but the result is an increased potential for water damage.

SUMMARY

In accordance with the present invention a piece of specially angled, ridged sheet metal containing openings for water to flow through is inserted into a gutter to form an upper and lower passageway.

Objects and Advantages

Gutters are designed to protect a house from water damage, specifically roof, fascia, soffit, siding, garage door, deck, porch and house foundation. The anti-clogging liner presented here helps a gutter do what a gutter is supposed to do—protect against water damage while successfully eliminating clogged gutters.

Accordingly several objects and advantages of this present invention are:

(1) to provide better protection for a roof (fascia, soffit, and shingles) from water damage;

(2) to provide better protection from overflows which cause damage to garage doors, decks, porches and house foundations;

(3) to provide better protection from snow and ice damage;

(4) to keep leaves, pine needles, and other debris out of the lower passageway of the gutter so water will always flow freely in the gutter to the downspout;

(5) to handle large volumes of water and eliminate overflows even during downpours;

(6) to handle high velocity water runoff from steep pitched roofs;

(7) to install easily without the need for tools;

(8) to install easily without nails, screws clips, hooks, springs, glue, or caulk;

(9) to reduce maintenance by assuring that leaves and debris never sit in water. Dry leaves can be easily removed by hand-held blower, brush or hand:

(10) to provide a sturdy, light-weight liner that is strong enough to hold up under all weather conditions or debris accumulation and does not add appreciably to the weight of the gutter;

(11) to provide a liner which is simple in design and inexpensive to manufacture; and

(12) to provide a liner which can fit into many different styles of guttering and effectively protect from clogging.

To summarize, the object and advantage of this anti-clogging liner is to provide an inexpensive, universal, easily maintained gutter liner to reduce clogging from debris while giving optimum protection from water damage, and which has the strength, durability, and flexibility to last many years in all kinds of weather. Further objects and advantages of this liner will become apparent from a consideration of the drawings and ensuing description.

DRAWING FIGURES

The drawings which depict specific embodiments of a gutter anti-clogging liner should not be construed as restricting the scope or spirit of the liner in any way.

REFERENCE NUMERALS IN DRAWINGS

Figure 1:
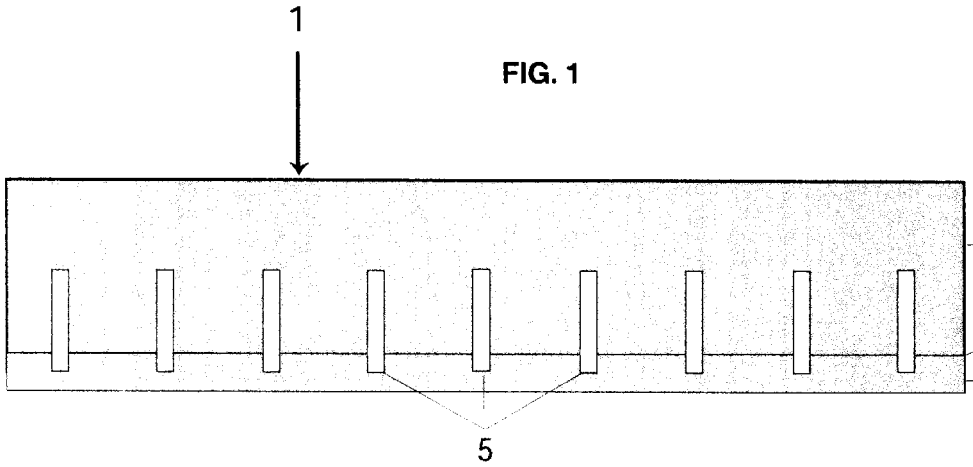
FIG. 1 is a front view of an anti-clogging liner with a parallel series of elongated slots extending laterally across the liner.

1. anti-clogging liner 3B rear 8. short plane
2. cross-pieces
3. gutter
3A front
3B rear
4. roof structure
5. openings
6. angled edge
7. long plane
8. short plane
9 wrap-around connector
11 upper passageway
12 lower passageway

DESCRIPTION—FIGS. 1, 2, 3, 4, and 5—SPECIFIC EMBODIMENTS

The present anti-clogging liner is a multi-purpose, universal-fit roof-rail gutter protection system which is useful in keeping debris out of the bottom portion of roof rain gutters and drain spouts. FIG. 1 shows a frontal view of this anti-clogging liner 1 which is constructed of an elongated strip of approximately 36" long 0.031 aluminum sheeting (or any other weatherproof metal or resilient plastic material sturdy, enough to support reasonable amounts of debris, ice and/or snow). A series of openings 5 are shown arranged in rows along the length of liner 1. Openings 5 are positioned so that they extend approximately halfway up long plane 7 and approximately halfway down short plane 8. Liner 1 allows for many types and styles of openings 5 that can be created through numerous types of manufacturing processes. There are potentially so many different type openings 5 that liner 1 does not claim the precise style, width, length, and number of any specific type. The slot type openings 5 in FIG. 3 are for illustration purposes only.

Figure 2:
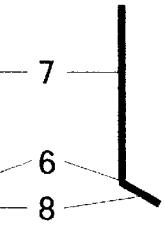
FIG. 2 is an end view of a liner showing an unspecified angular brake.

FIG. 2 is an end view of liner 1 showing angled edge 6 of approximately 60°. The precise angle is important to the proper functioning of liner 1, but angle edge 6 may vary depending upon gutter 3 size and style.

Figure 3:
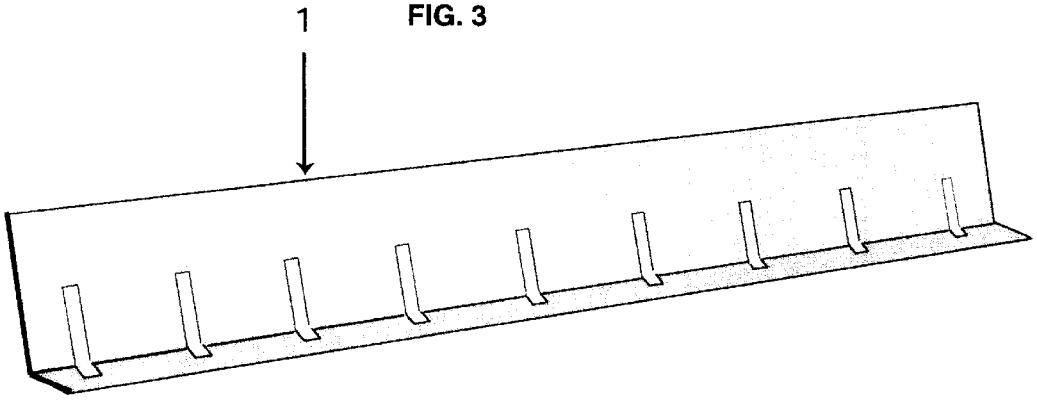
FIG. 3 is a perspective view of a liner as it would appear sitting by itself.

FIG. 3 is a perspective view of liner 1.

Figure 4:
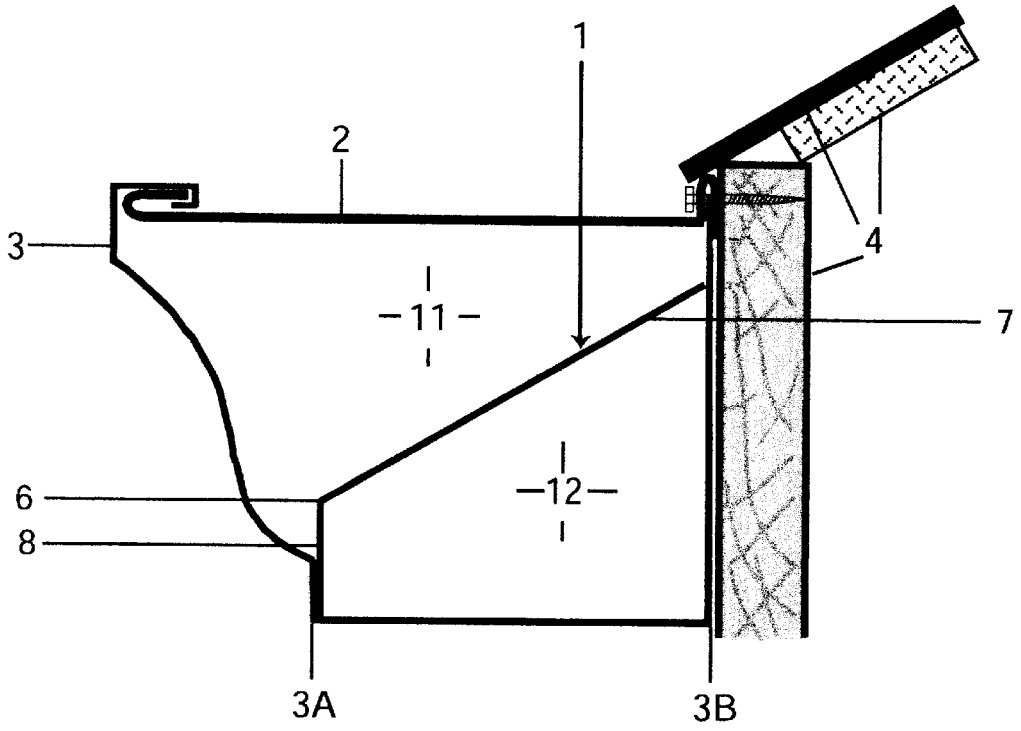
FIG. 4 illustrates a cross-sectional view of a rain gutter (requiring cross braces for roof attachment), partial roof edge, and an installed gutter anti-clogging liner. The rain gutter and roof structure are for illustrative purposes only and form no part of the claimed design.

FIG. 4 is an end view of liner 1 as it fits down into gutter 3 (as illustrated) underneath any type hangers or cross-pieces 2 as are known in the art. Such prior cross-pieces 2 include various types of cross-braces/hangers that are generally placed across gutter 3 at regular intervals and form the attachment between gutter 3 and roof structure 4. Cross-pieces 2 run perpendicular to the length of gutter 3 near the top of gutter 3 cavity and additionally, serve to strengthen gutter 3. Liner 1 comprises a plurality of single rectangular sheets of ridged material installed adjacent to each other in gutter 3, tinder cross-pieces 2. Liner 1 is installed without tools or fastener of any kind; it simply slides into place. Once installed, liner 1 creates an upper passageway 11 and a lower passageway 12 within gutter 3.

Figure 5:
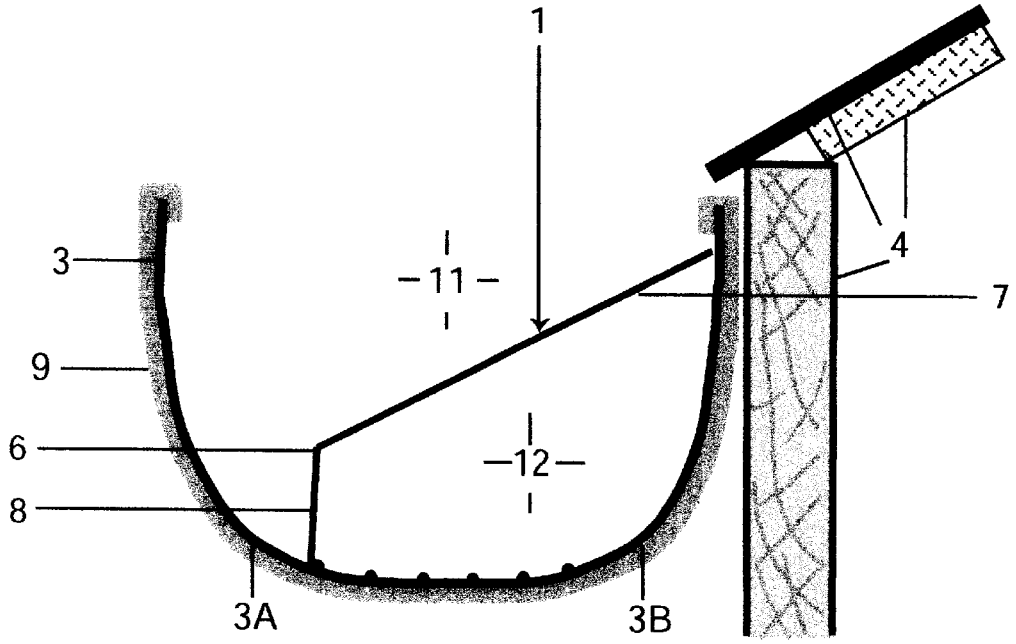
FIG. 5 illustrates a cross-sectional view of a rain gutter (requiring no cross braces for roof attachment), partial roof edge, and an installed gutter anti-clogging liner. The rain gutter and roof structure are for illustrative purposes only and form no part of the claimed design.

FIG. 5, (to illustrate the universalness of liner 1) is an end view of liner 1 as it fits down into gutter 3 (as illustrated). In this style of gutter 3, attachment to roof structure 4 is accomplished by means of a wrap-around connector 9—no cross-pieces 2 are needed. Liner 1 comprises a plurality) of single rectangular sheets of ridged material installed adjacent to each other in gutter 3. Liner 1 is installed without tools or fastener of any kind; it simply slides into place. Once installed, liner 1 creates an upper passageway 11 and a lower passageway 12 within gutter 3. Liner 1 can be inserted into most other styles of gutter 3 without adversely affecting its performance.

In both FIG. 4 and 5, short plane 8 of liner 1 is placed in against front 3A of gutter 3, perpendicular to the bottom of utter 3. With short plane 8 of liner 1 perpendicular-, long plane 7 of liner 1 drops into its designated spot near the top of real 3B of gutter 3, leaving liner 1 sloping down at an incline—from the upper part of rear 3B of gutter 3 down to the lower part of front 3A of gutter 3.

Liner 1 may be made by any manual or machining means know in the art. One preferred method of makings liner 1 utilizes cutting each piece to size and simultaneously drilling, punching, or forming holes into the desired configuration. Once the pieces are cut to size and contain the appropriate openings 5, angle 6 can be formed using a brake or some other forming device. Preferred dimensions for the individual pieces of liner 1 is 36" with a normal width (for 5" and 6" gutters) of 4¾ or 5½ respectively.

Operation—FIGS. 1, 2, 3, 4, and 5

The concept of liner 1 is based on the insertion of a piece of specially-angled, ridged material (containing predetermined openings 5 for water to flow through) directly into gutter 3. If cross-pieces 2 exist, liner 1 is placed in gutter 3 under cross-pieces 2 (See FIG. 4). If no cross-pieces 2 exist, liner 1 is placed directly into gutter 3 (See FIG. 5).

The basic installation principle involved is short plane 8 of liner 1 is placed vertically on bottom of gutter 3 and flush against the outside edge or front 3A of gutter 3. This positioning will hold liner 1 up away from the bottom of gutter 3 while long plane 7 of liner 1 will fall into place near the top inside or rear 3B of gutter 3 (underneath any support cross-pieces 2).

Openings 5 (notches, holes or slots) are located in liner 1 in sufficient number and size to assure a large volume of water will flow through them, but small enough to restrict the entry of leaves, seeds or other large debris into lower passage 12 of gutter 3. Openings 5 are located approximately halfway down short plane X of liner land extend upward—approximately halfway up long plane 7 of liner 1. Size, configuration, or number of openings 5 will depend on size and style of gutter 3; but there must be adequate space for substantial water to flow unhindered with minimal restrictions, even if leaves and debris are laying on liner 1.

The physical attributes of this conceptual design are simple. As water flows down the roof and off the last shingle of roof structure 4, the water falls directly into upper passageway 11 of gutter 3 onto long plane 7 of liner 1—(a reasonable free-fall distance is required to keep water or melted snow from coming in contact with the underside of roof structure 4). Immediately upon falling on long plane 7 of liner 1, the water is transported by gravity down the sloped inclined plane of long plane 7 to the bottom of front 3A of gutter 3 where it either flows down between front 3A of gutter 3 and plane 8 or into openings 5 to lower passable 12 of gutter 3. In either case, all water has been transported away from the shingles, sheathing, and fascia board. If leaves or debris have been carried into gutter 3, liner 1 restricts them from entering lower passageway 12 of gutter 3. Even if leaves and debris have accumulated on top of long plane 7 of liner 1, water falling from the shingles will make its way (via gravity) to the bottom of front 3A of gutter 3 (away from roof structure 4) and be carried down into unobstructed lower passageway 12 of gutter 3 where it will flow freely to the downspout. This is not the case with most prior art devices since they completely cover the mouth of gutter 3.

Conclusions, Ramifications, and Scope

Accordingly, it is seen that this inexpensive, anti-clogging liner has a simple, uncomplicated design that is extremely easy to manufacture, install, and maintain. Yet, it fulfills its primary function of keeping leaves and debris out of the lower passageway of the gutter so that no clogging occurs. In so doing, this liner provides optimal protection to a house from water, snow, and ice damage (specifically roof, fascia, soffit, siding, garage doors, decks, porches and house foundation). Other products, including the prior art which claim to keep leaves and debris out of a gutter, cannot assure the extent of water damage protection that this liner does. Furthermore, this liner has these additional advantages over the prior art in that:

- there is no restriction of water flow into the gutter due to leaves and debris laying on top of a screen or cover, since there is no screen or cover. Water, even large volumes, will flow directly into the gutter and not overflow the system onto the ground. This system's advantage is that it allows the water to immediately flow down into the gutter onto the liner. The water does not have to first flow through screen openings or into specified openings in a cover before it flows into the cutter.
- the accelerated flow of water down a steep pitched roof goes directly into the gutter and not over the sides onto the ground. This problem of overflowing is a persistent problem where screens or covers restrict the direct flow of water into the gutter, especially where leaves and debris have accumulated.
- it is made of semi-ridged material (aluminum or a material of similar strength, durability and flexibility) which will not collapse, bend or deteriorate under pressure from excessive debris, ice, snow, or extreme weather conditions. Since this liner is placed down into the gutter tinder the cross-pieces and is made of semi-ridged material, it will not become dislodged by wind or rain.

installation and removal is easy and time efficient. No tools are required. No screws, clips, hooks, glue, or caulking is required to fasten the liner to the gutter/roof. Each length of the liner is simply inserted under the gutter cross-pieces and slides into position along the longitudinally-extended gutter until it bulls up against the end of the utter or the previous length of liner. Removal is just as easy—just slid the pieces out from under the cross-pieces.

the original structural integrity of both gutter and roof structure are maintained, since there are no attachments to the gutter or roof system.

it provides an effective solution to eliminating damage to roof shingles, sheathing, or fascia board from melting snow and ice dams. In that the liner is not installed as a covering to the gutter, but fits within the gutter, any snow or ice buildup will be on top of the liner inside tile gutter tray. Because the liner slopes down and toward the front of the gutter, any water from melting snow/ice will follow the slope of the angle down into the lower passageway of the gutter. The roof system will be protected from any water backing up and seeping under the shingles because the melting snow is immediately transported into first the upper passageway and then into the lower passageway. The water is always being transported away from the roof structure.

its design is basic and uncomplicated; therefore, the manufacturing and installation costs are low, thus providing the customer with a relatively inexpensive gutter guard system that is effective in accomplishing its design function of controlling water runoff and assuring the gutter does not clog.

it requires far less maintenance than most other systems. Because the water flows into the lower passageway of the gutter, any leaves and debris are left on top of the liner to dry. Left in this position, there is no moisture for them to lay in and decay (no more wet and soggy leaf debris), so they dry out and are easily removed. Many times high winds will actually blow some of the leaves free of the liner; thus reducing the concern of build up and frequency of cleaning. In many cases (except where large numbers of trees overhang the system) there is little or no maintenance. When cleaning or maintenance is required, an inexpensive rain gutter brush (with an extension handle) or a leaf blower with extension can be used to quickly clear the gutter. No more digging out watery, decaying messes—just simply brush or blow the dry leaves or debris off the liner. The system can be effectively maintained without the use of ladders or getting up on the roof.

Although the description above contains many specificities, these should not be construed as limiting the scope of the liner, but as merely providing illustrations of some of the presently preferred embodiments of this liner. For example, the liner itself can be reversed in the gutter 180° and still function; the openings referred to can have other shapes, such as circular, oval, trapezoidal, triangular, etc; the liner can have different degree bends and can be located higher or lower across the horizontal plane, etc.

Thus the scope of the liner should be determined by the appended claims and their legal equivalents rather than by the examples given.

I claim:

1. A longitudinal water control device installed in a water gutter of a building's roof comprising:

a sheet of rigid material of sufficient size to fit inside a longitudinally extended roof gutter, said sheet bent longitudinally to a predetermined angle, resulting in a short plane and a long plane, said sheet provided with a plurality of spaced apart elongated openings extending therethrough, each said elongated opening extending into both said short plane and said long plane, a roof gutter having a first upstanding vertical side wall connecting to the roof of a house, said gutter having a second upstanding vertical side wall spaced from said first side wall, said gutter having a bottom planar wall interconnecting said side walls, said gutter being open at the top, said short horizontal plane rests vertically on said bottom planar wall flush against or in vertical proximity to said second side wall while said long horizontal plane rests against said first side wall, creating an inclined surface that separates an upper passageway from a lower passageway within said gutter.

* * * * *

UNITED STATES PATENT AND TRADEMARK OFFICE

CERTIFICATE OF CORRECTION

PATENT NO. : 6,282,845 B1
DATED : September 4, 2001
INVENTOR(S) : M. Genes Hines It is certified that error appears in the above-identified patent and that said Letters Patent is hereby corrected as shown below:

Title page, and column 3, line 17,
ABSTRACT, line 9, change "utter" to -- gutter --.

Column 4,
Line 38, change "1. anti-clogging liner 3B rear 8. short plane" to -- 1. anti-clogging liner --.
Line 58, change "roof-rail" to -- roof-rain --.

Column 5,
Line 23, change "tinder" to -- under --.
Line 42, change "utter" to -- gutter --.
Line 44, change "real" to -- rear --.
Line 49, change "know" to -- known --.
Line 49, change "makings" to -- making --.

Column 6,
Line 8, change "X of liner land" to -- 8 of liner 1 and --.
Line 23, change "passable" to -- passage --.

Column 7,
Line 5, change "tinder" to -- under --.
Line 12, change "bulls" to -- butts --.
Line 13, change "utter" to -- gutter --.
Line 23, change "tile" to -- the --.

Signed and Sealed this

Twenty-eighth Day of May, 2002

*Attest:*

*Attesting Officer*

JAMES E. ROGAN
*Director of the United States Patent and Trademark Office*